US010154702B1

(12) United States Patent
Neary et al.

(10) Patent No.: US 10,154,702 B1
(45) Date of Patent: Dec. 18, 2018

(54) BOTTOM GARMENT HAVING A COMFORT FIT LINER

(71) Applicant: VF Jeanswear Limited Partnership, Greensboro, NC (US)

(72) Inventors: Whitney Neary, Mission, KS (US); Amber Burke, Lee's Summit, MO (US); Angela Kathleen Primavera, Lenexa, KS (US); Hannah Alice Palmer, Kansas City, MO (US); Shawn Tilson Mueller, Prairie Village, KS (US); Robert Owen, Pleasant Hill, MO (US); Ye Reu De, ShunDe FoShan (CN); Surendar Sihag, Rajasthan (IN); Yu Hui Bin, ShunDe FoShan (CN); John D. Lindquist, Liberty, NC (US); Steven Charles Miller, Olathe, KS (US)

(73) Assignee: VF Jeanswear Limited Partnership, Greensboro, NC (US)

( * ) Notice: Subject to any disclaimer, the term of this patent is extended or adjusted under 35 U.S.C. 154(b) by 189 days.

(21) Appl. No.: 15/264,783

(22) Filed: Sep. 14, 2016

Related U.S. Application Data

(60) Provisional application No. 62/218,210, filed on Sep. 14, 2015.

(51) Int. Cl.

| | |
|---|---|
| ***A41D 27/20*** | (2006.01) |
| ***A41D 27/02*** | (2006.01) |
| ***A41D 1/06*** | (2006.01) |
| ***A41D 1/14*** | (2006.01) |
| ***A41F 9/00*** | (2006.01) |

(52) U.S. Cl.
CPC ..... *A41D 27/02* (2013.01); *A41D 1/06* (2013.01); *A41D 1/14* (2013.01); *A41D 27/20* (2013.01); *A41F 9/00* (2013.01); *A41D 2300/30* (2013.01); *A41D 2500/10* (2013.01)

(58) Field of Classification Search
CPC ..... A41D 2400/38; A41D 1/06; A41D 27/02; A41D 2300/20; A41C 1/003; A41B 2400/38
See application file for complete search history.

(56) References Cited

U.S. PATENT DOCUMENTS

| | | | | |
|---|---|---|---|---|
| 3,127,896 | A | 4/1964 | Puliafico | |
| 6,035,448 | A | 4/2000 | Thomson | 2/227 |
| 6,311,333 | B1 | 11/2001 | Batra | 2/237 |
| D459,055 | S | 6/2002 | Hosogai | D2/742 |

(Continued)

*Primary Examiner* — Bobby Muromoto, Jr.
(74) *Attorney, Agent, or Firm* — MacCord Mason PLLC

(57) ABSTRACT

A bottom garment for providing comfort to the wearer. The bottom garment may include a front panel and a back panel, both the front panel and the back panel formed of a high weft-stretch fabric. The bottom garment may also include a garment lining formed of a higher weft-stretch fabric, low weight fabric attached on the inside of the panels inside of the garment, above a crotch point of the bottom garment. The stretch in the weft direction of the garment lining is greater than a stretch in the weft direction of the front panel and the back panel. The stretch in the warp direction of the garment lining is less than the stretch in the weft direction of the garment lining. The bottom garment may further include an elastic support band for maintaining the position of the garment when the garment is worn.

46 Claims, 9 Drawing Sheets

(56) References Cited

U.S. PATENT DOCUMENTS

| | | | | |
|---|---|---|---|---|
| D467,705 | S | 12/2002 | Leflet et al. | D2/742 |
| D550,428 | S | 9/2007 | Kern | D2/742 |
| 7,341,500 | B2 | 4/2008 | Horn et al. | 450/95 |
| D588,782 | S | 3/2009 | Rudes | D2/742 |
| D600,429 | S | 9/2009 | Mackintosh | D2/742 |
| D627,137 | S | 11/2010 | Keavey et al. | D2/743 |
| 7,950,069 | B2 | 5/2011 | Lee | 2/227 |
| D641,127 | S | 7/2011 | Zarabi | D2/712 |
| D641,134 | S | 7/2011 | Zarabi | D2/712 |
| D641,135 | S | 7/2011 | Zarabi | D2/712 |
| 8,621,670 | B2 | 1/2014 | Hansen | 2/237 |
| 8,683,616 | B2 | 4/2014 | Zielinski | 2/76 |
| 8,959,665 | B1 | 2/2015 | Garner et al. | 2/237 |
| 8,984,668 | B2 | 3/2015 | Tulin et al. | 2/227 |
| 9,320,306 | B2 | 4/2016 | Freddi et al. | A41D 1/06 |
| 9,326,552 | B2 | 5/2016 | Hays et al. | A41C 1/08 |
| D793,033 | S * | 8/2017 | Neary | D2/742 |
| 9,775,386 | B2 * | 10/2017 | Forsythe | A41D 1/14 |
| 2005/0034219 | A1 * | 2/2005 | Lowry | A41D 1/06 2/227 |
| 2007/0118954 | A1 * | 5/2007 | Lee | A41C 1/003 2/69 |
| 2007/0136930 | A1 * | 6/2007 | Dipietro | A41D 1/06 2/227 |
| 2011/0099677 | A1 * | 5/2011 | Mamiye | A41D 27/02 2/67 |
| 2014/0273741 | A1 * | 9/2014 | Hays | A41D 1/06 450/95 |
| 2015/0164151 | A1 * | 6/2015 | James | A41D 1/06 450/95 |
| 2015/0201679 | A1 | 7/2015 | Wong | A41D 1/06 |
| 2016/0174642 | A1 | 6/2016 | Rotter et al. | A41D 31/02 |
| 2016/0213076 | A1 * | 7/2016 | Forsythe | A41D 1/06 |
| 2017/0318864 | A1 * | 11/2017 | Carroll | A41B 11/003 |

* cited by examiner

BOTTOM GARMENT HAVING A COMFORT FIT LINER

BACKGROUND

(1) Field

The inventions of the present disclosure relate generally to apparel and, more particularly, to a bottom garment adapted to provide improved comfort to the wearer.

(2) Related Art

Jeans and the like are a staple garment found in most closets. Many wearers like the look of jeans but desire a more comfortable fit. Over time, the styling and components of some jeanswear has changed in various ways to accommodate such consumer demands.

Jeans composed of denim and blends with elastic fibers have become popular sellers because of their comfort and improved styling. However, due to the stretch nature of the material, this type of jean may be purchased in smaller than usual sizing in order to maintain a fit while accommodating for the stretch built into the garment. The stretch may make the jean more comfortable in some aspects; however, the seams of the garment typically do not share the same stretch parameters of the jean material and may create an uncomfortable point of contact with the wearer's skin, especially when the garment is worn in smaller than usual sizing.

In some jeanswear, the styling has changed to incorporate a lower waistline. Lower waistlines in bottom garments may also contribute to consumers purchasing smaller than usual sizes in order to secure the garment with a tighter fit. This too may create an increased abrasion of the garment against the skin. Lower waistlines also may require that different undergarments be worn with the garment. Such undergarments may include less coverage fabric, thus less material between the jean and the skin, so that the undergarment may actually contribute to chafing or result in decreased comfort from the increased direct contact between the jean and the skin.

Yoga clothing, such as yoga bottoms, is gaining acceptance with consumers as a comfortable alternative as a bottom garment. While yoga clothing has gained more acceptance as everyday wear, it is still associated with workouts and often thought to be too informal for many situations where jeans or other bottom garments are appropriate. Some attempts have been made to mimic the look of jeans in yoga bottoms in order to gain the look of jeanswear while also having the smooth, stretchy comfort of yoga wear. However, a good alternative addressing these difficulties is yet to be found.

Thus, there remains a need for a new and improved bottom garment which provides improved comfort to the wearer while, at the same time, does not compromise the wear's desired style.

SUMMARY

The inventions of the present disclosure are directed to a bottom garment for providing comfort to the wearer. The bottom garment includes a front panel and a back panel, both the front panel and the back panel formed of a high weft-stretch fabric. The bottom garment also includes a garment lining formed of a higher weft-stretch fabric, low weight fabric attached on the inside of the panels inside of the garment, above the crotch point of the bottom garment, wherein the stretch in the weft direction of the garment lining is greater than a stretch in the weft direction of the front panel and the back panel and wherein the stretch in the warp direction of the garment lining is less than the stretch in the weft direction of the garment lining. The bottom garment may further include an elastic support band for maintaining the position of the garment when the garment is worn. The bottom garment may also further include at least one pocket assembly.

In one embodiment, the stretch of the front panel and the back panel in the weft direction is greater than about 25% when tested according to ASTM D2594-04 (2012). The stretch of the front panel and the back panel in the weft direction may be between about 25% and about 60% when tested according to ASTM D2594-04 (2012). In one embodiment, the stretch of the front panel and the back panel in the weft direction is about 50% when tested according to ASTM D2594-04 (2012).

Also, in one embodiment, the stretch of the garment lining in the weft direction is greater than about 80% when tested according to ASTM D2594-04 (2012). The stretch of the garment lining in the weft direction may be between about 80% and about 200% when tested according to ASTM D2594-04 (2012). In one embodiment, the stretch of the garment lining in the weft direction is about 150% when tested according to ASTM D2594-04 (2012).

The garment lining may be formed of a knitted fabric. The knitted fabric may be a circular knit fabric. In one embodiment, the knitted fabric is an interlock circular knit fabric having about 43 wales per inch and about 38 courses per inch and 16 gauge. The knitted fabric may be a synthetic yarn fabric. The knitted fabric may be a 100% polyester yarn fabric. In one embodiment, the knitted fabric is formed of 75 denier, 72 filament multi-filament yarn.

The knitted fabric may between about 2 oz/sq yd and about 6 oz/sq yd. In one embodiment, the knitted fabric is about 4 oz/sq yd.

The elastic support band may include at least one elastic strip around the waist of the bottom garment. In one embodiment, the at least one elastic strip around the waist of the bottom garment is between the inside of the garment and the garment lining.

The pocket assembly may include a pocket facing and a pocket liner, the pocket liner configured to form a pocket bag, the pocket liner having an attachment to lower end of the pocket facing and an attachment to an upper pocket portion of the front panel.

The front panel may further include a fly assembly. The fly assembly may be selected from the group consisting of zippers, buttons, hook and loop fasteners, hook and eye, snap and string ties. In one embodiment, the fly assembly further includes a single ply fly on a first fly portion, the first fly portion having an inner side attached to a lining cover.

The back panel may further include a hip pocket assembly. The hip pocket assembly may be selected from the group consisting of patch pockets, welt pockets, insert pocket and hidden pockets.

The bottom garment includes jeans, pants, capris, skirts and shorts.

Accordingly, one aspect of the inventions of the present disclosure is to provide a bottom garment for providing comfort to the wearer, the garment including a front panel; a back panel with both the front panel and the back panel formed of a high weft-stretch fabric. A garment lining formed of a high weft-stretch fabric, low weight fabric is attached on the inside of the panels inside of the garment, above the crotch point of the bottom garment. The stretch in the weft direction of the garment lining is greater than the stretch in the weft direction of the front panel and the back panel. The stretch in the warp direction of the garment lining is less than the stretch in the weft direction of the garment lining.

Another aspect of the inventions of the present disclosure is to provide a bottom garment for providing comfort to the wearer, the garment including a front panel; a back panel, both the front panel and the back panel being formed of a high weft-stretch fabric. A garment lining being formed of a higher weft-stretch fabric, low weight fabric attached on the inside of the panels inside of the garment, above the crotch point of the bottom garment. The stretch in the weft direction of the garment lining is greater than the stretch in the weft direction of the front panel and the back panel and the stretch in the warp direction of the garment lining is less than the stretch in the weft direction of the garment lining. An elastic support band for maintaining the position of the garment is include when the garment is worn.

Still another aspect of the inventions of the present disclosure is to provide a bottom garment for providing comfort to the wearer, the garment including a front panel, a back panel, and both the front panel and the back panel formed of a high weft-stretch fabric. A garment lining formed of a higher weft-stretch fabric, low weight fabric being attached on the inside of the panels inside of the garment, above the crotch point of the bottom garment. The stretch in the weft direction of the garment lining is greater than a stretch in the weft direction of the front panel and the back panel and the stretch in the warp direction of the garment lining is less than the stretch in the weft direction of the garment lining. An elastic support band may be included for maintaining the position of the garment when the garment is worn. The front panel may further include at least one pocket assembly.

These and other aspects of the inventions of the present disclosure will become apparent to those skilled in the art after a reading of the following description of the preferred embodiments when considered with the drawings.

DETAILED DESCRIPTION OF EMBODIMENTS

Figure 1:
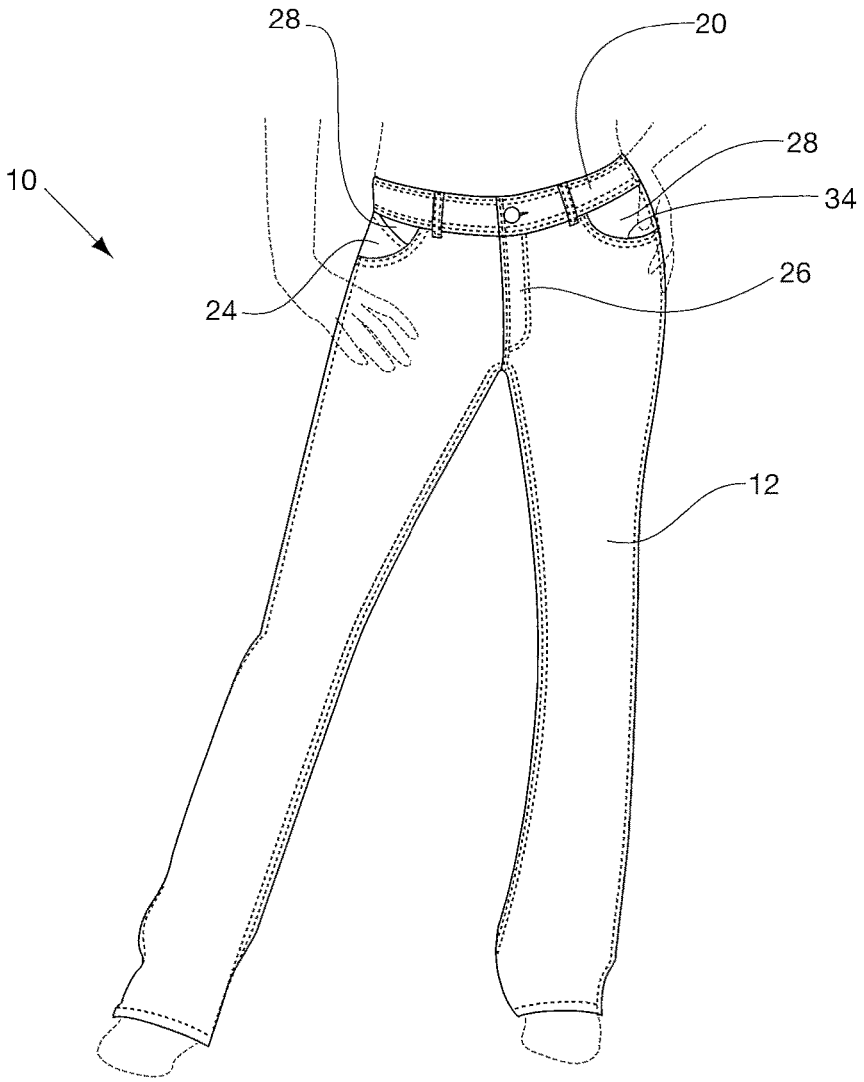
FIG. 1 is a front external view of a garment constructed according to one embodiment of the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
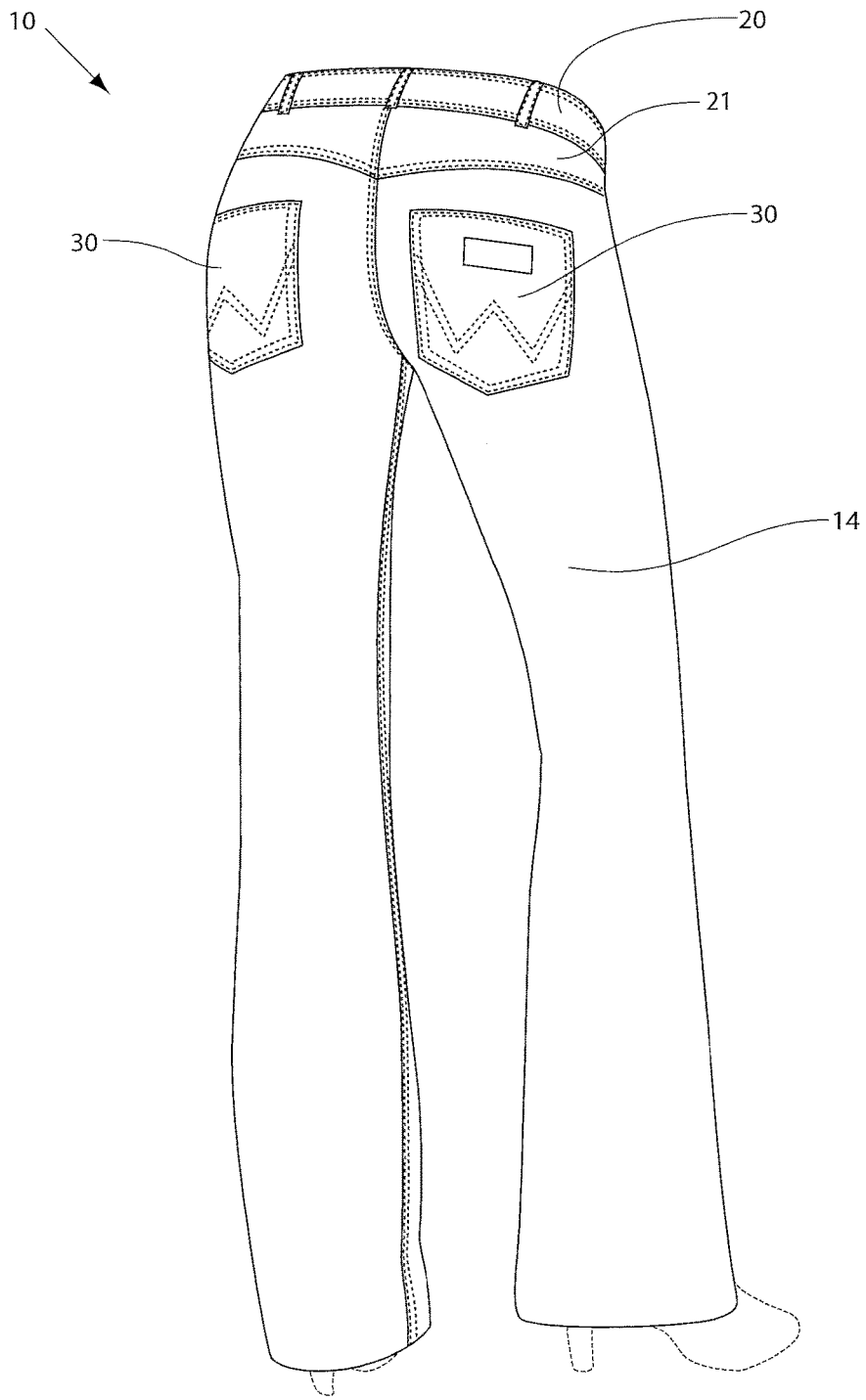
FIG. 2 is a back external view of the garment as shown in FIG. 1.

Referring now to the drawings in general and FIGS. 1 and 2 in particular, it will be understood that the illustrations are for the purpose of describing preferred embodiments of the inventions and are not intended to limit the inventions thereto. As best seen in FIG. 1, a bottom garment, generally designated 10, is shown constructed according to the present disclosure. The bottom garment 10 includes three major sub-assemblies: a front panel 12; a back panel 14; and a garment lining 16 (see FIG. 3*b*) attached to the inside of the garment 10'.

As seen in FIG. 1, there is a front view of an outer bottom garment 10 constructed according the present disclosure and shown as worn by a user. The appearance of bottom garment 10 from the front is generally conventional in design. The bottom garment 10 may further include pocket assemblies 24 that may include a pocket facing 28. The bottom garment 10 may also further include a fly assembly 26 which may consists of zippers, buttons, hook and loop fasteners, hook and eye snap, string ties, and other conventional fly assemblies. The fly assembly may include a first fly portion 27 and a second fly portion 29 (see FIG. 5). Bottom garment 10 may also include a waistband 20. The waistband 20 may extend from the front of the bottom garment 10 around the back of bottom garment 10.

Turning next to FIG. 2, a back view of an outer bottom garment 10 is shown as worn by the user. The appearance of bottom garment 10 from the rear appears to a casual observer to be generally conventional in design. Back panel 14 may further include a hip pocket assembly 30. Hip pocket assembly 30 may, for example, be selected from the group consisting of patch pockets, welt pockets, insert pockets and hidden pockets and other conventional pockets.

Figure 7A:
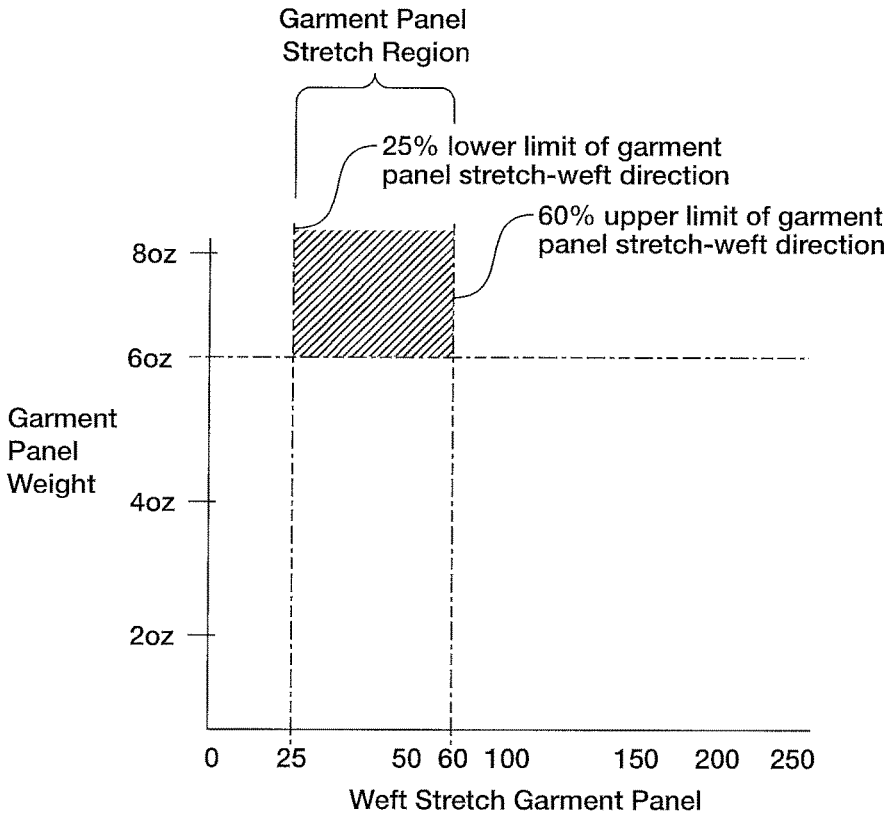
FIG. 7A illustrates one embodiment of the construction details of the present disclosure of garment panel weight and weft stretch of the garment panel.

Front and back panels 12, 14 may be formed of a high weft-stretch fabric. The front and back panels 12, 14 may, for example, be a stretch denim fabric for jeans and/or suitable fabrics used for pants, capris, skirts and/or shorts. In one example, (see FIG. 7A) the stretch of the front panel 12 and back panel 14 in the weft direction is greater than about 25% when tested according to ASTM D2594-04 (2012). In another example, the stretch of the front panel 12 and back panel 14 in the weft direction is between about 25% and about 60% when tested according to ASTM D2594-04 (2012). In other embodiments, the stretch of the front panel 12 and back panel 14 in the weft direction is about 50% when tested according to ASTM D2594-04 (2012). In other examples, panels 12 and 14 may have a stretch exceeding 50% in the weft direction when tested according to ASTM D2594-04 (2012). In other examples, the stretch of the panels 12, 14 may be less than about 25% when tested according to ASTM D2594-04 (2012).

Figure 3A:
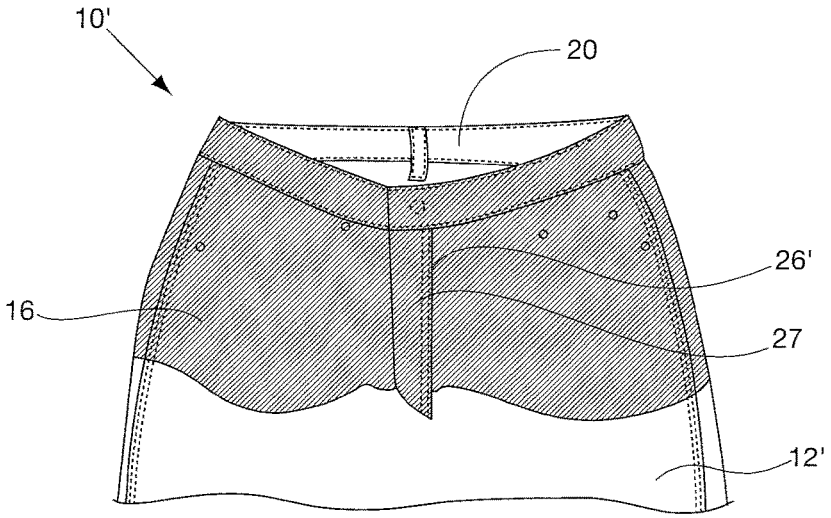
FIG. 3A is front inside-out view of another example of a garment constructed according to one embodiment of the present disclosure.
Figure 3B:
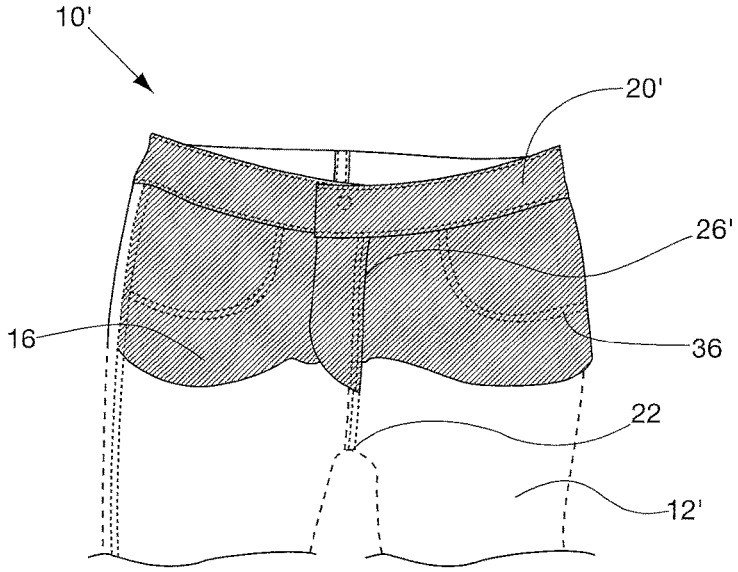
FIG. 3B is another example of a front inside-out view of the garment as shown in FIG. 1.
Figure 4:
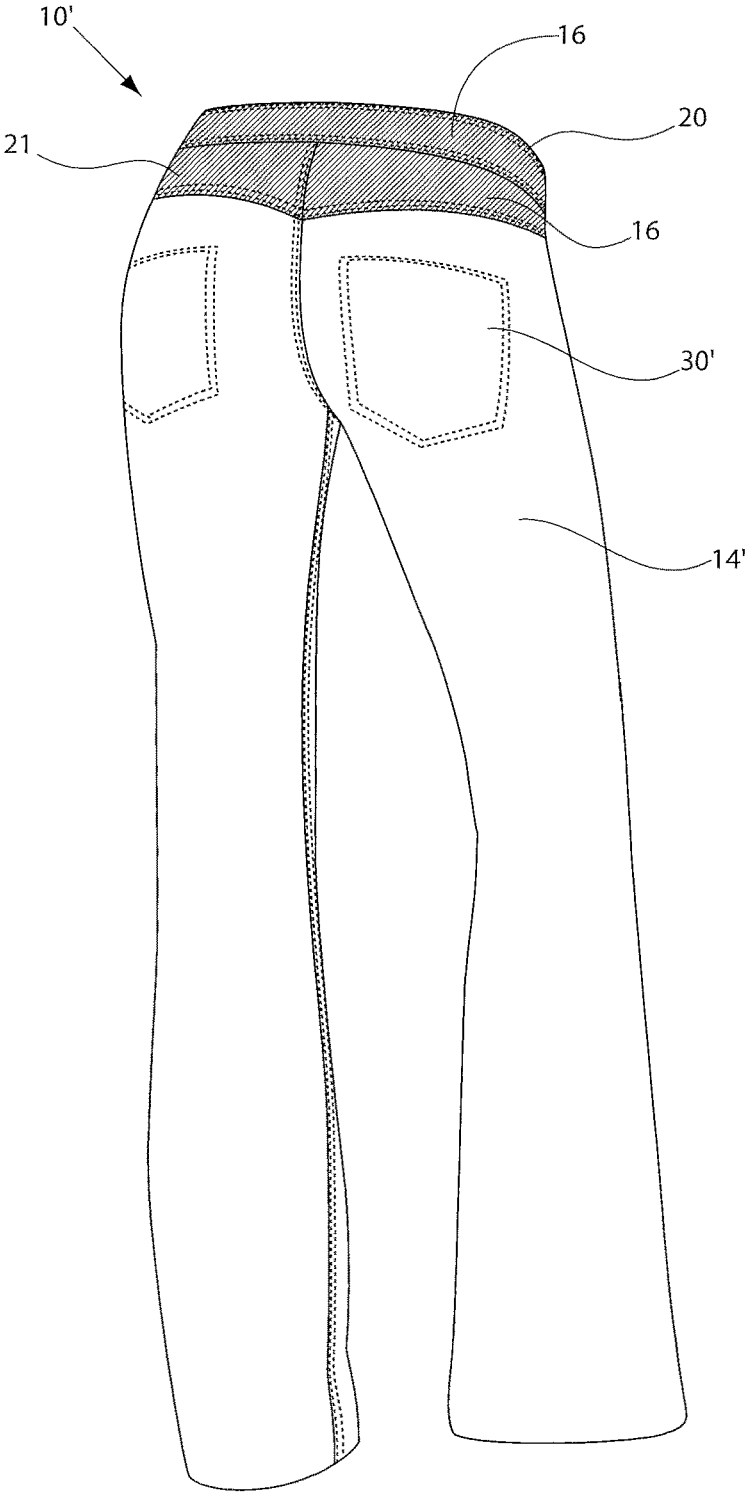
FIG. 4 is a back inside-out view of the garment as shown in FIG. 2.

FIGS. 3A, 3B and 4 show front and back views of garments turned inside-out 10' to show an inside-out depiction of example embodiments of the inventions of the present disclosure, including a garment lining 16. Lining 16 attaches on the inside of the garment 10'. Lining 16 may cover at least a portion of the inside of panels 14' and/or 16'.

Lining 16 may cover at least a portion of the inside pocket assembly 24'. In some embodiments, lining 16 may cover at least a portion of the fly assembly 26'. Lining 16 may also cover at least a portion of the inside of waistband 20. Lining 16 may cover a riser The lining 16 may be a one piece lining attached to the inside of bottom garment 10'. The lining 16 may be more than one piece covering one or more of the sub-assemblies, for example, front panel 12, back panel 14, waistband 20, pocket assembly 24, hip pocket assembly 30 and/or fly assembly 26. The lining, for example, may be attached, such as stitched, into the garment inside at the edges of the respective assemblies. Lining 16 as seen in FIG. 4, may be attached to cover the back portion (as well as the front portion of the waistband) of the waistband 20 and/or a riser 21. The bottom garment may or may not include a riser 21. If a riser is included in the garment, the riser 21 may or may not include a lining 16. In other embodiments, the lining 16 may also cover hip pocket assemblies 30' or portions thereof.

Figure 5:
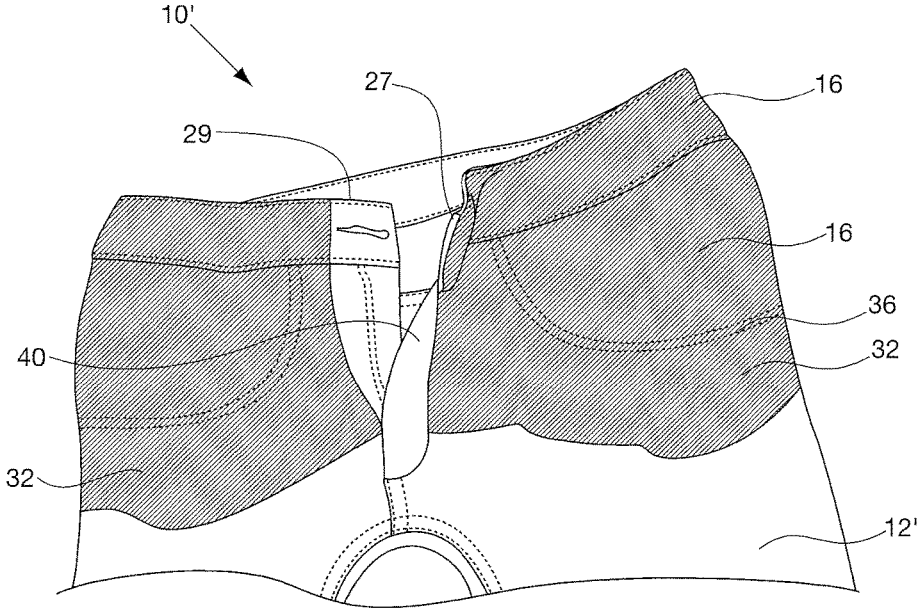
FIG. 5 is a front inside-out view of the garment as shown in FIG. 3B with a fly portion folded to show a single ply fly attached to a fly liner.

FIG. 5 shows a fly assembly 26. Fly assembly 26 may include a double ply fly on a first portion 27 and/or second portion 29. In some examples, fly 26 may include a single ply fly on a first fly portion 27. The first fly portion 27 includes a single ply fly layer 40 attached on an inner side of the garment 10' to the lining 16. A second fly portion 29 may be a single ply layer or more than one ply layer. The single ply fly layer 40 allows the comfort fit lining 16 to be added to the fly assembly while minimizing extra bulk created by multiple layers in the fly area of the garment 10. In some embodiments, the lining 16 may cover the garment rivets and/or button, encasing them between the garment and lining. In other examples, the back of the rivets/buttons may remain exposed on the lining side of the garment.

Figure 6:
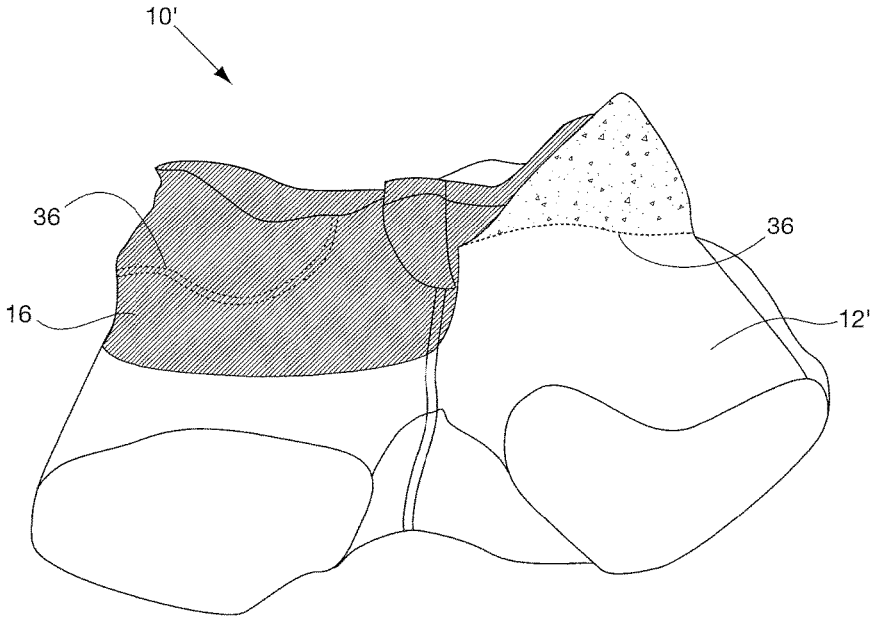
FIG. 6 is a front inside-out view of the garment as shown in FIG. 3B showing a portion of the liner lifted to illustrate one example of the liner attachment to the garment.

In some embodiments, as seen in FIGS. 5 and 6, pocket assembly 24 includes a pocket facing 28 (see FIG. 1) and a portion of the liner forming a pocket liner 32, such that pocket liner 32 is configured to form a pocket bag. In such examples, the pocket liner 32 includes an attachment 36 to a lower end of the pocket facing 28 and an attachment 34 to an upper pocket portion of the front panel 12'. In some embodiments, the pocket liner 32 and its attachments 34, 36 occur on the right and left side of the garment 10, so that front pockets of the garment 10 are entirely and/or substantially formed of liner 16. In this embodiment, liner 16 should be durable enough to function as a pocket material but a lightweight fabric with a high-weft stretch. In some embodiments, the liner 16 material may be a different material from the garment material. The pockets of the garment may be made of the liner material. In other embodiments, the garment may include a garment material, a pocket material and a liner material, each which may be different materials.

Figure 7B:
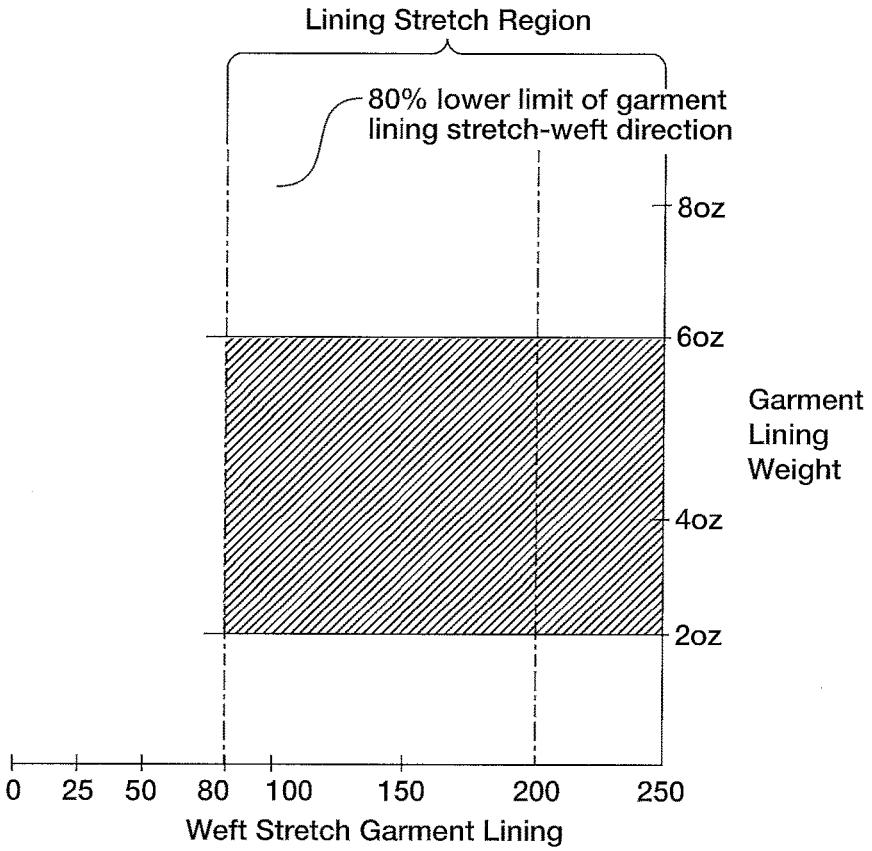
FIG. 7B illustrates one embodiment of construction details of the present disclosure of garment lining weight and weft stretch of garment lining.

Garment lining 16, in one embodiment, is attached on the inside of panels 12, 14 above a crotch point 22 on the bottom garment. In one example, the lining 16 is formed of a high weft-stretch, low weight fabric. As seen in FIG. 7B, the stretch of the garment lining 16 in the weft direction is greater, in some examples, than about 80% when tested according to ASTM D2594-04 (2012). In other examples, the stretch of garment lining 16 in the weft direction is between about 80% and about 200% when tested according to ASTM D2594-04 (2012). The stretch of the garment lining 16, in other embodiments, in the weft direction is about 150% when tested according to ASTM D2594-04 (2012). The stretch of the garment lining 16 in the weft direction may also be below 80% or above 200% when tested according to ASTM D2594-04 (2012).

The garment lining 16 may be formed of a knitted fabric. The knitted fabric, in some examples, is a circular knit fabric. In other examples, the knitted fabric is an interlock circular knit fabric having about 43 wales per inch and about 38 courses per inch and 16 gauge. The knitted fabric may also be a synthetic yarn fabric. The knitted fabric may be a 100% polyester yarn fabric. In other embodiments, the knitted fabric is formed of 75 denier, 72 filament multi-filament yarn. The knitted fabric may be between about 2 oz/sq yd and about 6 oz/sq yd. The knitted fabric may be about 4 oz/sq yd.

In one embodiment, a suitable garment lining may, by way of example, be Fabric Reference Number FNVF0123-16 available from Fountain Set.

Figure 7C:
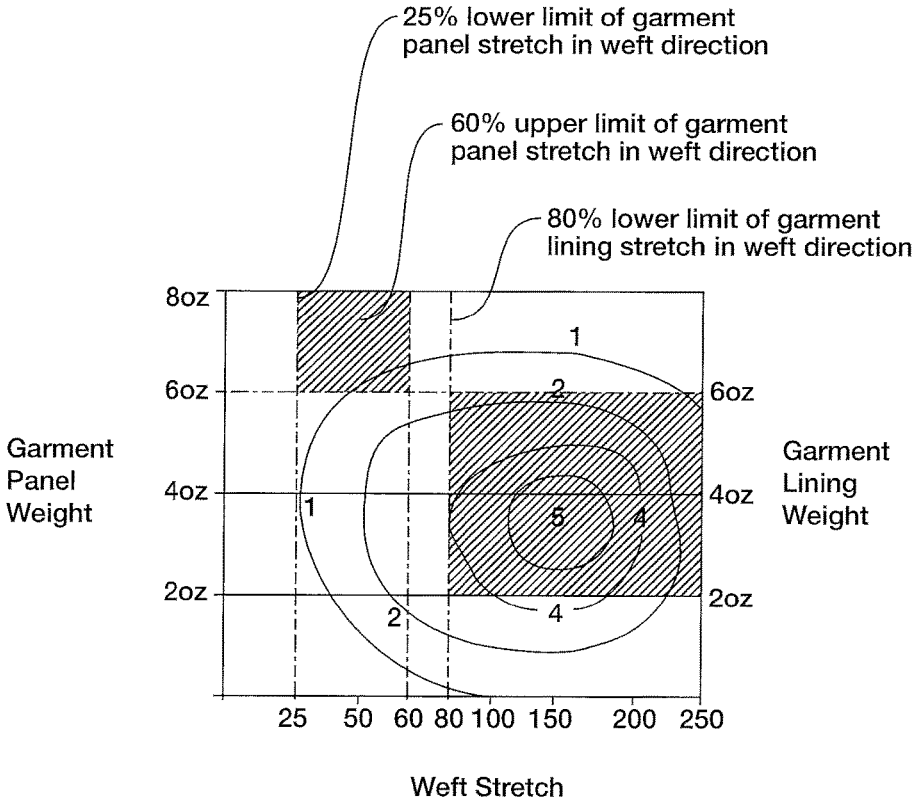
FIG. 7C is a graphical representation of a garment lining formed of a high weft-stretch, low weight fabric lining where the stretch in the weft direction of the garment lining is greater than the stretch in the weft direction of the panel.

As shown in FIG. 7C, in some examples, the stretch in the weft direction (horizontal) of the garment lining 16 is greater than a stretch in the weft direction (horizontal) of the front panel 12. The stretch in the weft direction of the garment lining 16 may also be greater than a stretch in the weft direction of the back panel 14. In use, when the wearer puts on the garment, the lining 16 expands to the wearer's body and the garment slides on easily. The liner 16 often has a smooth feel to the touch of the user, much as yoga garments, and may also include a heathering appearance of soft yoga type garments. In some examples, the lining 16 is less than about 6 ounces to be lightweight and provide a slick, comfortable feel to the wearer, and more than about 2 ounces to be durable enough to be sustainable during repetitive wash and wear. The lining 16 may also be a knit that stretches from about at least 50% to at least about 250%, such that the lining 16 stretches greater in the weft direction than the garment panels 12, 14 of garment 10 so the lining is not restrictive to the wearer more so than the garment. Typically, the garment 10 expands less than the lining 16 resulting in a lining 16 that provides a soft cushioning, expanding feel to the wearer since the lining is less restrictive to the wearer than the garment. Area 5 depicts a preferred embodiment range for garment panel weigh and weft stretch in view of garment panel lining weight and weft stretch. Outside of the area 1 range, the garment stretch begins to exceed the lining stretch and/or the weight of the lining begins to compete with the garment weight, taking on potentially some less desirable characteristics for a comfort fit liner (given the parameters of the example provided).

In some embodiments, the stretch in the warp direction (vertical) of the garment lining 16 is less than the stretch in the weft direction of the garment lining 16.

In other embodiments, the garment 10 also includes a support band. The support band may be an elastic support band for maintaining the position of the garment when the garment is worn. The elastic support band may include at least one elastic strip around the waist 20 of the bottom garment 10. At least one elastic strip around the waist of the bottom garment 10 may be located between the inside of the garment 10' and the garment lining 16. In some examples, more than one elastic support band may be included in or with the waistband 20. Elastic strips may be placed at variable positions of the waistband 20 between the liner 16 and the garment 10.

Certain modifications and improvements will occur to those skilled in the art upon a reading of the foregoing description. By way of example, while one embodiment shown in the above disclosure illustrates a bottom garment 10 that may include jeans, pants, culottes and shorts, it should be clear that the inventions of the present disclosure may be modified, as disclosed, to further include a garment liner in garments include skirts and top garments, such as, shirts, vests and jackets. Still other improvements might include partially covering the inside of a garment assembly with the garment lining and/or completely covering the inside of a garment with the garment lining; attaching a garment liner using various stitching methods; and providing a seam masking garment liner when the liner covers the seams of the garment that may be high friction and highly restrictive garment areas since the garment may stretch less at some of the garment seams. It should be understood that all such modifications and improvements have been deleted herein for the sake of conciseness and readability but are properly within the scope of the following claims.

We claim:

1. A bottom garment for providing comfort to the wearer, said garment comprising:

(a) a front panel;

(b) a back panel, both said front panel and said back panel formed of a high weft-stretch fabric; and (c) a garment lining formed of a high weft-stretch, low weight fabric attached on an inside of said panels inside of said garment, above a crotch point of said bottom garment, wherein a stretch in the weft direction of said garment lining is greater than a stretch in the weft direction of said front panel and said back panel, wherein a stretch in the warp direction of said garment lining is less than the stretch in the weft direction of said garment lining, wherein a pocket assembly includes a pocket facing and a pocket liner, said pocket liner configured to form a pocket bag, the pocket liner having an attachment to a lower end of the pocket facing and an attachment to an upper pocket portion of said front panel, and wherein a fly assembly further includes a single ply fly on a first fly portion, said first fly portion having an inner side attached to a lining cover.

2. The garment according to claim 1, wherein said front panel further includes at least one pocket assembly.

3. The garment according to claim 1, wherein said front panel further includes a fly assembly.

4. The garment according to claim 3, wherein said fly assembly is selected from the group consisting of zippers, buttons, hook and loop fasteners, hook and eye, snap and string ties.

5. The garment according to claim 1, wherein said back panel further includes a hip pocket assembly.

6. The garment according to claim 5, wherein said hip pocket assembly is selected from the group consisting of patch pockets, welt pockets, insert pocket and hidden pockets.

7. The garment according to claim 1, wherein said bottom garment includes jeans, pants, capris, skirts and shorts.

8. A bottom garment for providing comfort to the wearer, said garment comprising:

(a) a front panel;

(b) a back panel, both said front panel and said back panel formed of a high weft-stretch fabric;

(c) a garment lining formed of a higher weft-stretch, low weight fabric attached on an inside of said panels inside of said garment, above a crotch point of said bottom garment, wherein a stretch in the weft direction of said garment lining is greater than a stretch in the weft direction of said front panel and said back panel, wherein a stretch in the warp direction of said garment lining is less than the stretch in the weft direction of said garment lining, (d) an elastic support band for maintaining a position of the garment when the garment is worn, wherein a pocket assembly includes a pocket facing and a pocket liner, said pocket liner configured to form a pocket bag, the pocket liner having an attachment to a lower end of the pocket facing and an attachment to an upper pocket portion of said front panel, and wherein a fly assembly further includes a single ply fly on a first fly portion, said first fly portion having an inner side attached to a lining cover.

9. The garment according to claim 8, wherein the stretch of said front panel and said back panel in the weft direction is greater than about 25% when tested according to ASTM D2594-04 (2012).

10. The garment according to claim 9, wherein the stretch of said front panel and said back panel in the weft direction is between about 25% and about 60% when tested according to ASTM D2594-04 (2012).

11. The garment according to claim 10, wherein the stretch of said front panel and said back panel in the weft direction is about 50% when tested according to ASTM D2594-04 (2012).

12. The garment according to claim 9, wherein the stretch of said garment lining in the weft direction is greater than about 80% when tested according to ASTM D2594-04 (2012).

13. The garment according to claim 12, wherein the stretch of said garment lining in the weft direction is between about 80% and about 200% when tested according to ASTM D2594-04 (2012).

14. The garment according to claim 13, wherein the stretch of said garment lining in the weft direction is about 150% when tested according to ASTM D2594-04 (2012).

15. The garment according to claim 8, wherein said garment lining is formed of a knitted fabric.

16. The garment according to claim 15, wherein said knitted fabric is a circular knit fabric.

17. The garment according to claim 16, wherein said knitted fabric is an interlock circular knit fabric having about 43 wales per inch and about 38 courses per inch and about 16 gauge.

18. The garment according to claim 15, wherein said knitted fabric is a synthetic yarn fabric.

19. The garment according to claim 18, wherein said knitted fabric is a 100% polyester yarn fabric.

20. The garment according to claim 19, wherein said knitted fabric is formed of 75 denier, 72 filament multifilament yarn.

21. The garment according to claim 8, wherein said knitted fabric is between about 2 oz/sq yd and about 6 oz/sq yd.

22. The garment according to claim 21, wherein said knitted fabric is about 4 oz/sq yd.

23. The garment according to claim 8, wherein said elastic support band includes at least one elastic strip around the waist of said bottom garment.

24. The garment according to claim 23, wherein said at least one elastic strip around the waist of said bottom garment is between the inside of the garment and said garment lining.

25. A bottom garment for providing comfort to the wearer, said garment comprising:

(a) a front panel;

(b) a back panel, both said front panel and said back panel formed of a high weft-stretch fabric;

(c) a garment lining formed of a higher weft-stretch, low weight fabric attached on an inside of said panels inside of said garment, above a crotch point of said bottom garment, wherein a stretch in the weft direction of said garment lining is greater than a stretch in the weft direction of said front panel and said back panel, wherein a stretch in the warp direction of said garment lining is less than the stretch in the weft direction of said garment lining;

(d) an elastic support band for maintaining a position of the garment when the garment is worn;

(e) wherein said front panel further includes at least one pocket assembly, wherein said pocket assembly includes a pocket facing and a pocket liner, said pocket liner configured to form a pocket bag, the pocket liner having an attachment to a lower end of the pocket facing and an attachment to an upper pocket portion of said front panel, and wherein a fly assembly further includes a single ply fly on a first fly portion, said first fly portion having an inner side attached to a lining cover.

26. The garment according to claim 25, wherein said front panel further includes a fly assembly.

27. The garment according to claim 26, wherein said fly assembly is selected from the group consisting of zippers, buttons, hook and loop fasteners, hook and eye, snap and string ties.

28. The garment according to claim 25, wherein said back panel further includes a hip pocket assembly.

29. The garment according to claim 28, wherein said hip pocket assembly is selected from the group consisting of patch pockets, welt pockets, insert pocket and hidden pockets.

30. The garment according to claim 25, wherein said bottom garment includes jeans, pants, capris, skirts and shorts.

31. The garment according to claim 25, wherein the stretch of said front panel and said back panel in the weft direction is greater than about 25% when tested according to ASTM D2594-04 (2012).

32. The garment according to claim 31, wherein the stretch of said front panel and said back panel in the weft direction is between about 25% and about 60% when tested according to ASTM D2594-04 (2012).

33. The garment according to claim 32, wherein the stretch of said front panel and said back panel in the weft direction is about 50% when tested according to ASTM D2594-04 (2012).

34. The garment according to claim 31, wherein the stretch of said garment lining in the weft direction is greater than about 80% when tested according to ASTM D2594-04 (2012).

35. The garment according to claim 34, wherein the stretch of said garment lining in the weft direction is between about 80% and about 200% when tested according to ASTM D2594-04 (2012).

36. The garment according to claim 35, wherein the stretch of said garment lining in the weft direction is about 150% when tested according to ASTM D2594-04 (2012).

37. The garment according to claim 25, wherein said garment lining is formed of a knitted fabric.

38. The garment according to claim 37, wherein said knitted fabric is a circular knit fabric.

39. The garment according to claim 38, wherein said knitted fabric is an interlock circular knit fabric having about 43 wales per inch and about 38 courses per inch and 16 gauge.

40. The garment according to claim 37, wherein said knitted fabric is a synthetic yarn fabric.

41. The garment according to claim 40, wherein said knitted fabric is a 100% polyester yarn fabric.

42. The garment according to claim 41, wherein said knitted fabric is formed of 75 denier, 72 filament multi-filament yarn.

43. The garment according to claim 25, wherein said knitted fabric is between about 2 oz/sq yd and about 6 oz/sq yd.

44. The gait lent according to claim 43, wherein said knitted fabric is about 4 oz/sq yd.

45. The garment according to claim 25, wherein said elastic support band includes at least one elastic strip around the waist of said bottom garment.

46. The garment according to claim 45, wherein said at least one elastic strip around the waist of said bottom garment is between the inside of the garment and said garment lining.

* * * * *